US005555011A

United States Patent [19]

Tang et al.

[11] Patent Number: 5,555,011

[45] Date of Patent: Sep. 10, 1996

[54] LAMINATION OF A PROTECTIVE LAYER OVER AN IMAGE PRODUCED BY A THERMAL PRINTER

[75] Inventors: Manh Tang, Penfield; Kin K. Lum, Webster; James E. Pickering, Holcomb, all of N.Y.

[73] Assignee: Eastman Kodak Company, Rochester, N.Y.

[21] Appl. No.: 187,240

[22] Filed: Jan. 26, 1994

[51] Int. Cl.[6] ..... B41J 2/325

[52] U.S. Cl. ..... 347/212; 347/215

[58] Field of Search ..... 346/76 PH; 400/120, 400/248, 120.18; 347/215, 216, 217, 218, 212

[56] References Cited

U.S. PATENT DOCUMENTS

| | | | |
|---|---|---|---|
| 4,495,014 | 1/1985 | Gebrian et al. | 156/80 |
| 4,738,555 | 4/1988 | Nagashima | 400/240 |
| 4,815,872 | 3/1989 | Nagashima | 400/120 |
| 5,176,458 | 1/1993 | Wirth | 346/76 PH |

FOREIGN PATENT DOCUMENTS 2258843 2/1993 United Kingdom .

*Primary Examiner*—Huan H. Tran
*Attorney, Agent, or Firm*—Milton S. Sales

[57] ABSTRACT

A thermal printer has converging paths for dye-donor web and receiver medium. The paths abut before proceeding past the thermal head. A transport system moves the dye-donor web and the receiver medium (i) in a forward direction along their respective paths past a thermal head, whereat heat from the thermal head causes an area of the laminate material coating between leading and trailing edges to transfer from the dye-donor web to the receiver medium and (ii) in a reverse direction along their respective paths such that the area of the laminate material which is transferred to the receiver medium breaks cleanly at said trailing edge from a non-laminated area of the laminate material that remains on the aye-donor web as the web support separates from the receiver medium.

10 Claims, 5 Drawing Sheets

FIG. 3
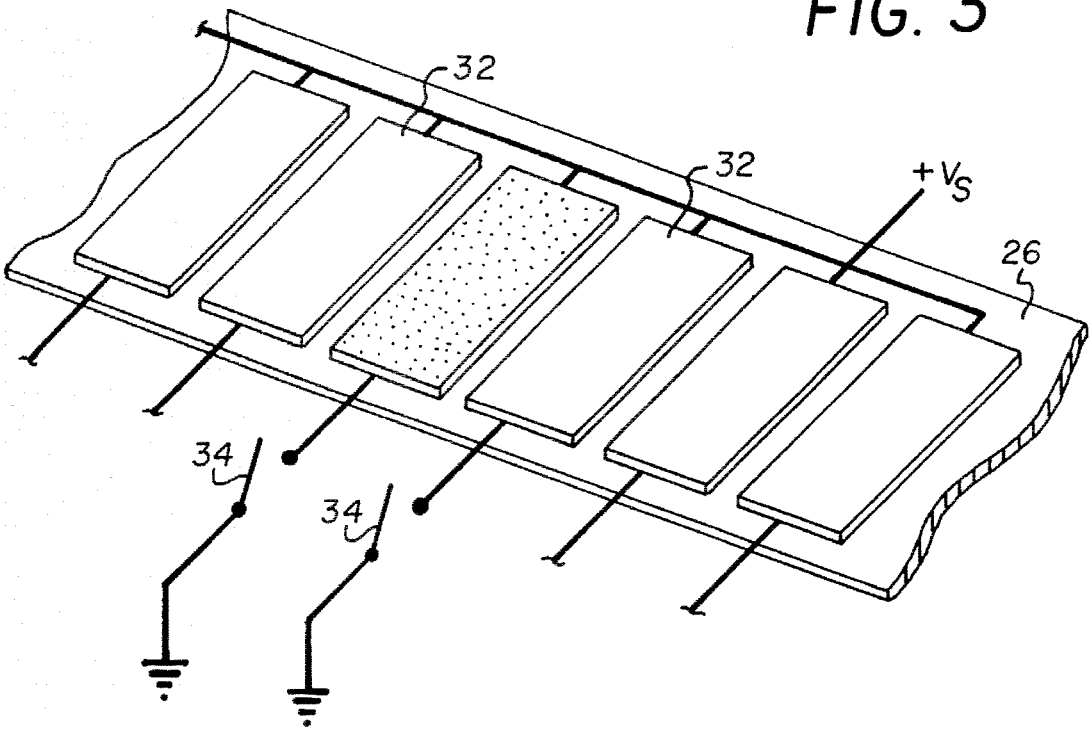
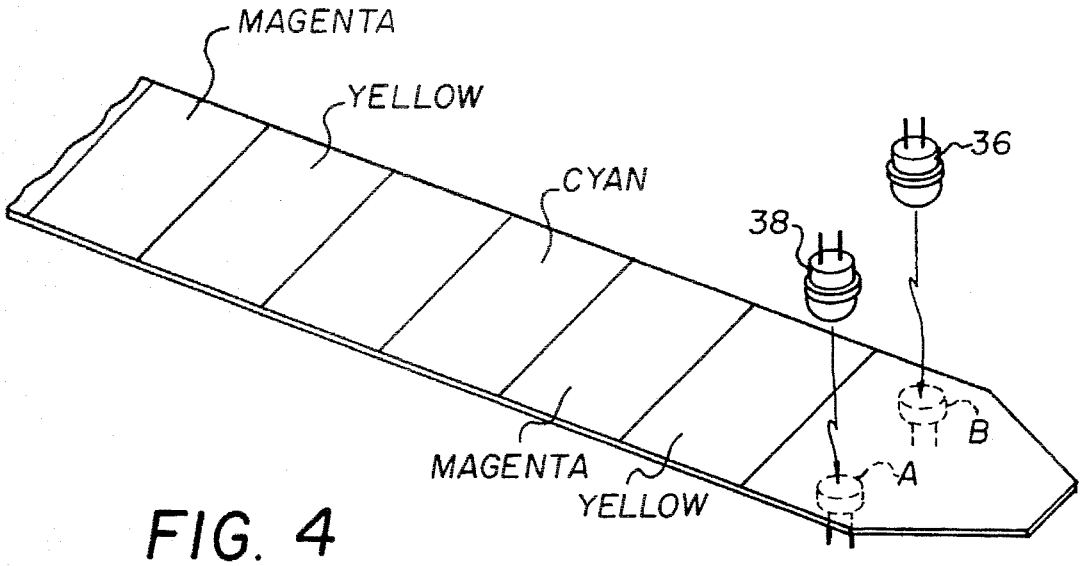
FIG. 4

LAMINATION OF A PROTECTIVE LAYER OVER AN IMAGE PRODUCED BY A THERMAL PRINTER

BACKGROUND OF THE INVENTION

1. Technical Field

This invention relates generally to thermal printers having a transport system for moving a receiver medium and a dye-donor web past a thermal print head to transfer a dye image to the receiver medium; and more particularly to such printers wherein the dye-donor web carries a clear, thermally-transferable laminate material that can be applied onto the receiver medium over the dye image to form a protective layer.

2. Background Art

Thermal dye images suffer from handling-induced artifacts. Fingerprints are especially of concern, as the body chemicals seriously deteriorate the dye image. It is known to apply a protective layer on top of the dye image using thermally-transferable laminate materials. For example, see U.S. Pat. No. 4,738,555, which issued to M. Nagashima on Apr. 19, 1988. The thermally-transferable laminate material that forms the protective layer is carried as a separate patch on the dye-donor web, and is transferred by applied heat from the print head.

Often, a problem occurs during the process of transferring the laminate material from the dye-donor web to the receiver medium. The portion of the thermally-transferable material that is actually laminated to the receiver medium tends to not break away cleanly from the non-laminated portion of the thermally-transferable material, leaving ragged, uneven edges as shown in FIG. 1 of the accompanying drawings. Prior attempts to solve this problem, such as that described in UK Patent Application GB 2,258,843 which was published on Feb. 24, 1993, involved the application of excess thermal energy at the lamination edges.

DISCLOSURE OF THE INVENTION

It is an object of the present invention to apply a protective layer over a thermal dye image on a receiver medium using a thermally-transferable laminate material which is carried as a separate patch on the dye-donor web, and is transferred by heat from the print head with a sharp, straight trailing edge without the application of excess thermal energy at the trailing edge.

It is another object of the present invention to produce a uniform separation of a laminate at the trailing edge of the lamination by rewinding the receiver medium and the dye-donor web after laminating the last line, while simultaneously controlling the dye-donor web tension and the print head position.

According to one aspect of the present invention, a thermal printer has converging paths for the dye-donor web and the receiver medium. The paths abut before proceeding past the thermal head. A transport system moves the web and the receiver medium (i) in a forward direction along their respective paths past the thermal head whereat heat from the thermal head causes an area of the laminate material coating between leading and trailing edges to transfer from the dye-donor web to the receiver medium and (ii) in a reverse direction along their respective paths such that the area of the laminate material which is transferred to the receiver medium breaks cleanly at said trailing edge from a non-laminated area of the laminate material that remains on the dye-donor web as the web support separates from the receiver medium.

According to a preferred embodiment of the present invention, the laminate material is applied to the receiver medium to overlie an image carried on the receiver medium. A receiver medium guide is positioned between the converging paths to guide the receiver medium to the thermal head and to act as a stripping bar so that the area of the laminate material which is transferred to the receiver medium breaks from the non-laminated area of the laminate material as the trailing edge passes the receiver medium guide.

The invention and its various objects and advantages will become more apparent to those skilled in the art from the ensuing detailed description of the preferred embodiments presented below, the accompanying drawings, and the appended claims.

BRIEF DESCRIPTION OF THE DRAWINGS

In the detailed description of the preferred embodiments of the invention presented below, reference is made to the accompanying drawings, in which:

FIG. 3 is a schematic perspective of several heating elements used in the print head of the printer of FIG. 2;

FIG. 4 shows a portion of a typical dye-donor web;

BEST MODE FOR CARRYING OUT THE INVENTION

The present description will be directed in particular to elements forming part of, or cooperating more directly with, apparatus in accordance with the present invention. It is to be understood that elements not specifically shown or described may take various forms well known to those skilled in the art. While the invention is described below in the environment of a dye-sublimation thermal printer, it will be noted that the invention can be used with other types of thermal printers.

Figure 2:
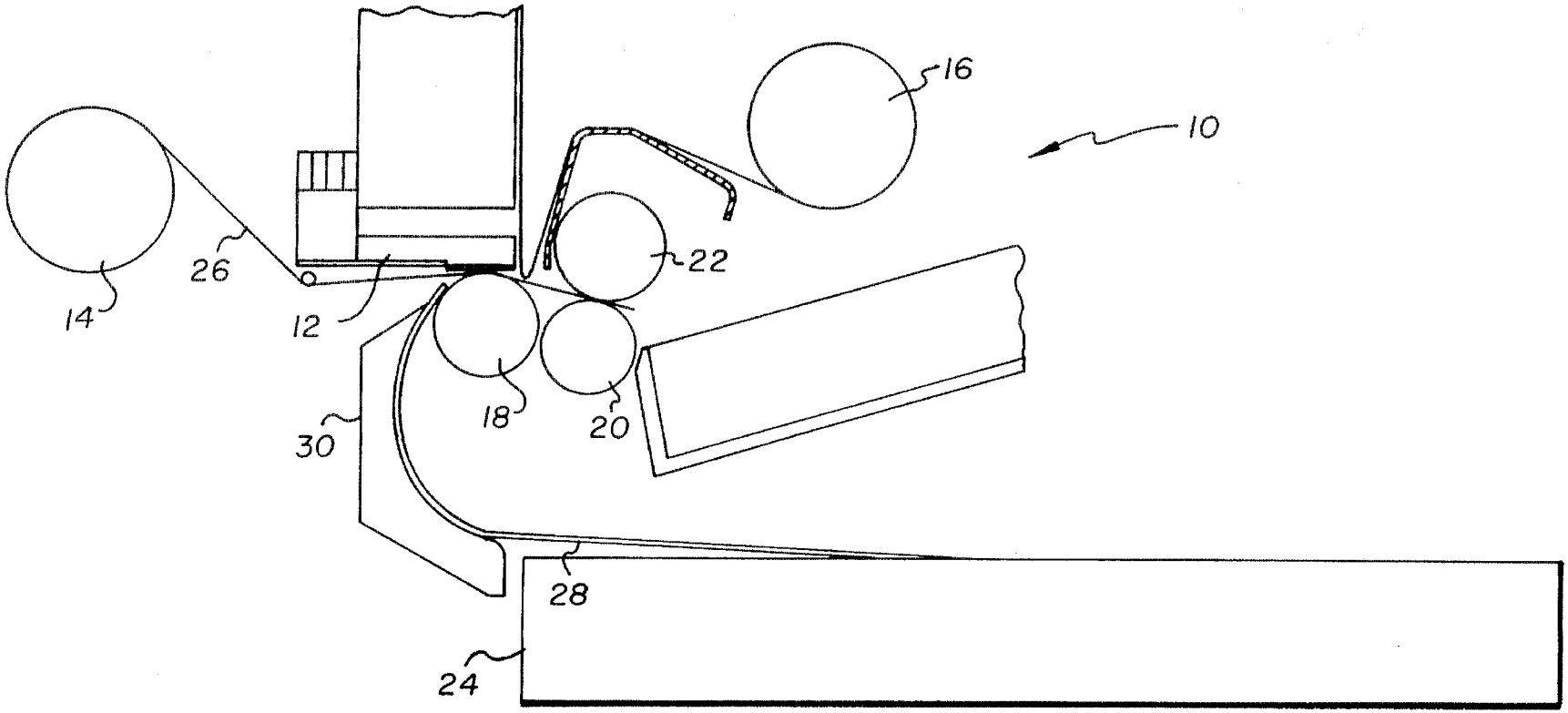
FIG. 2 is a schematic of a thermal printer which can be employed to make color images in a dye receiver medium in accordance with this invention.

Referring to FIG. 2, a thermal printer 10 according to a preferred embodiment of the present invention includes a print head assembly 12 and dye-donor web supply and take-up spools 14 and 16, respectively. A main printer support structure includes a roller platen assembly 18, a pair of dye receiver medium transport mechanism pinch rollers 20 and 22, and a dye receiver medium supply 24.

Normal thermal printer operations include loading dye receiver medium, printing information upon the dye receiver medium and ejecting the finished print. Each of these operations is fully described in commonly-assigned U.S. Pat. No. 5,176,458, which issued to H. G. Wirth on Jan. 5, 1993. The disclosure of that patent is hereby incorporated into this specification by reference, and therefore only a brief description will be herein given of the illustrated embodiment of the thermal printer.

Printer operation begins with a loading phase, in which print head assembly 12 moves to a loading position. A dye-donor web 26 and a sheet 28 of dye receiver medium advance along converging paths to a printing location, and print head assembly 12 is positioned in preparation for the printing operation.

As a sheet 28 of dye receiver medium advances, it moves along a guide 30 to follow a curved path toward a gap between print head assembly 12 and platen assembly 18. As the dye receiver medium moves into this gap, it contacts dye-donor web 26 and is guided toward dye receiver medium transport mechanism pinch rollers 20 and 22. While this embodiment describes dye receiver medium in sheet form, dye receiver medium supplied in roll form could also be utilized.

Once dye receiver medium 28 is firmly held by dye receiver medium transport mechanism pinch rollers 20 and 22, print head assembly 12 moves toward platen assembly 18, pressing dye-donor web 26 and dye receiver medium 28 against platen assembly 18 to form a sandwich for thermal printing.

When the loading phase is completed, printer 10 enters a printing phase, during which print head assembly 12 presses dye-donor web 26 and dye receiver medium 28 into platen assembly 18, and prints information on the dye receiver medium.

Referring to FIG. 3, the print head of print head assembly 12 includes a plurality of heating elements 32, such as electrical resistors, which are pressed against dye-donor web 26 to force the dye-donor web against dye receiver medium 28. When one of a plurality of switches 34 is closed, the associated heating element 32 is connected to a voltage potential source $V_s$. The amount of dye transferred is a function of the time period that switch 34 is closed.

Dye-donor web 26 comprises a leader portion followed by a repeating series of dye frames. The dye frames may be contiguous as shown or spaced by interframe regions, and, as shown in FIG. 4, each series includes in sequence yellow, magenta, and cyan dye frames. A single series is used to print one color plane on dye receiver medium 28.

In this disclosure, the term "dye" refers to a colored material which transfers from the dye-donor web to a dye receiver medium in response to energy applied by individual elements of the print head. According to the illustrated embodiment of the present invention, each of the repeating series of dye frames on dye-donor web 26 is followed by a frame coated with laminate material. The laminate material is preferable clear, and also transfers from the dye-donor web to a dye receiver medium in response to energy applied by individual elements of the print head. While the laminate material is shown carried by the dye-donor web, those skilled in the art will understand that the laminate material may be carried by a separate web and applied over the image at a lamination station downstream of the print head.

Although the print head is shown as having electrically resistive heating elements 32, those skilled in the art will understand that other sources of energy such as, diode laser array and individual lasers have been and can be effectively used in accordance with this invention. After a color plane is formed on the dye receiver medium, the dye receiver medium will be referred to as a print.

As shown, there are two LEDs 36 and 38 which illuminate the dye-donor web from above. LED 36 emits green light and LED 38 emits blue light. Two photodetectors "A" and "B" are disposed below the dye-donor web and receive light which passes through the dye-donor web. Photodetectors "A" and "B" provide a signals for identifying the start of series and each individual color dye frame in such series. For a more complete discussion of this identification, reference is made to commonly assigned U.S. Pat. No. 4,710,781 to S. Stephenson, the disclosure of which is incorporated by reference herein. It will be understood to those skilled in the art that other types of well known apparatus can be used to identify the start of each series of colored dye frames. See for example U.S. Pat. No. 4,893,951.

Thus, color thermal printers form a print by successively printing a single color onto a receiver medium, and returning the receiver medium to the beginning point; whereupon another color is printed. This process continues until all the required colors on the dye-donor web have been printed onto the receiver medium. To apply the laminate materials over the dye image, the printer repeats the above process for the additional patch of laminate material on the dye-donor web. That is, the print head is raised, and the dye-donor web is moved to the beginning of a patch of thermally-transferable laminate material. The receiver medium is repositioned such that the beginning of the image to be coated aligns with the print head. The print head is then lowered, and the lamination process begins, with the print head applying heat and pressure to the dye-donor web such that the laminate material transfers to the receiver medium.

Figure 1:
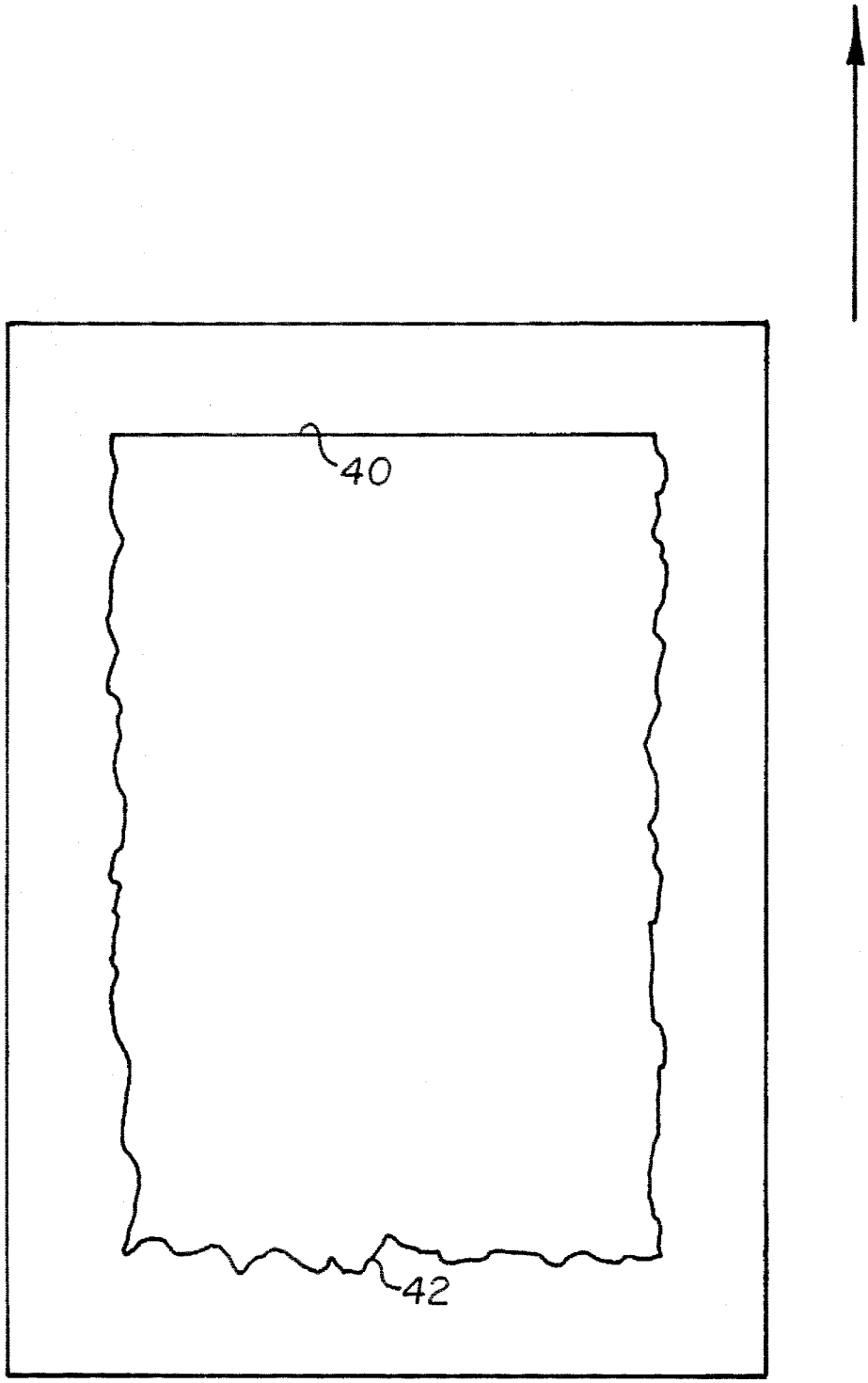
FIG. 1 (PRIOR ART)
FIG. 1 is a top plan view of a receiver medium with a thermally-transferable material laminated over a portion thereof according to the prior art.

Referring to FIG. 1, note that in a typical print which has been laminated with a protective material using the above-described process, the leading edge 40 of the final image is usually substantially more uniform than the trailing edge 42, which appears ragged in the figure. In accordance with the present invention, it has been determined that the difference in appearance of the leading and trailing edges of the laminate is due, at least in part, to the differences in the direction of the separation force of the dye-donor web relative to the receiver medium for the two edges.

Figure 5:
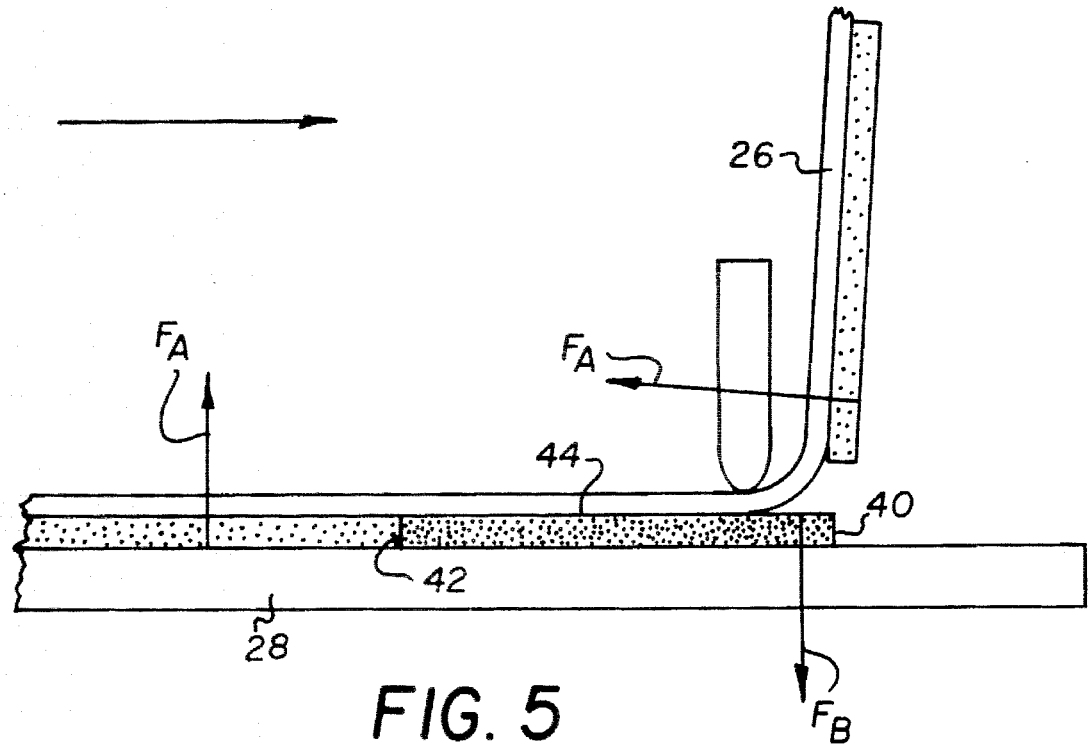
FIG. 5 is a side elevation view, partially in section illustrating the forces on the dye-donor web and the receiver medium during laminate separation at the leading edge of the lamination according to the prior art.
Figure 6:
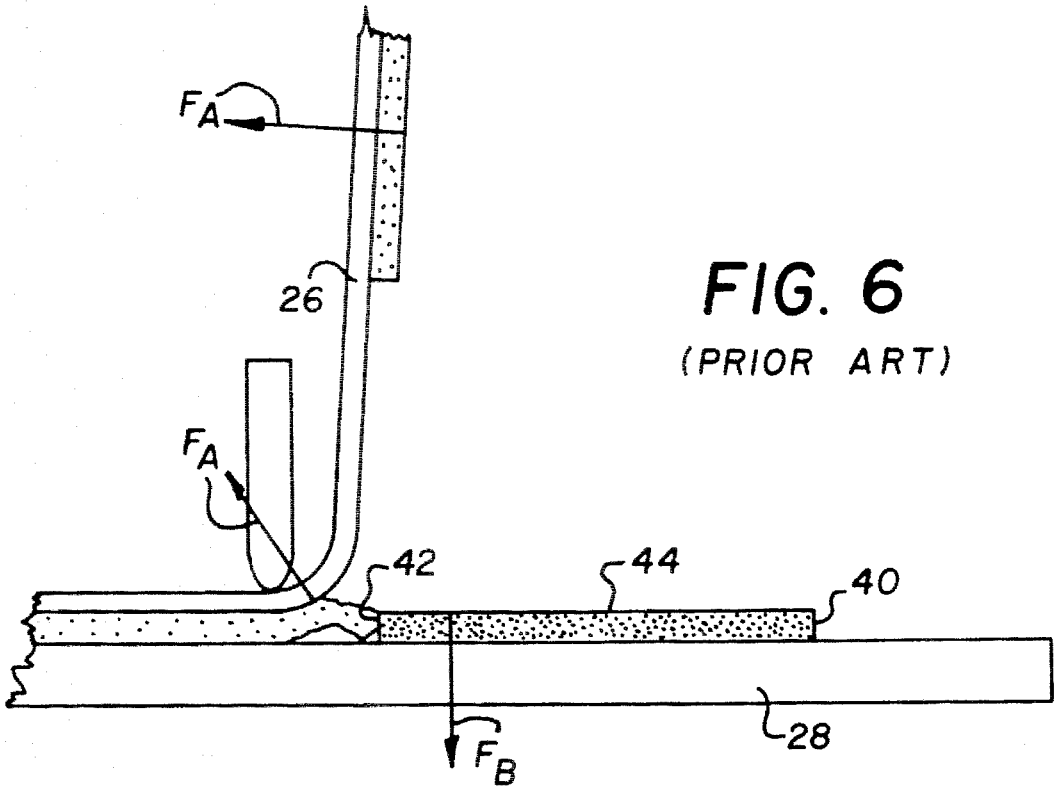
FIG. 6 (PRIOR ART)
FIG. 6 is a side elevation view, partially in section illustrating the forces on the dye-donor web and the receiver medium during laminate separation at the trailing edge of the lamination according to the prior art.

In way of explanation, compare FIGS. 5 and 6, which are side elevation views, partially in section, illustrating the forces on the dye-donor web and the receiver medium during laminate separation at the leading and trailing edges, respectively, of the lamination according to the prior art. Referring first to the leading edge of the lamination as shown in FIG. 5, note that the leading edge 40 of the transferred portion 44 of the laminate material is forced to separate from dye-donor web support 26. Now, referring to trailing edge 42 of the lamination as shown in FIG. 6, note that the trailing edge of the transferred portion 44 of the laminate material is forced to separate from receiver medium 28.

Figure 7:
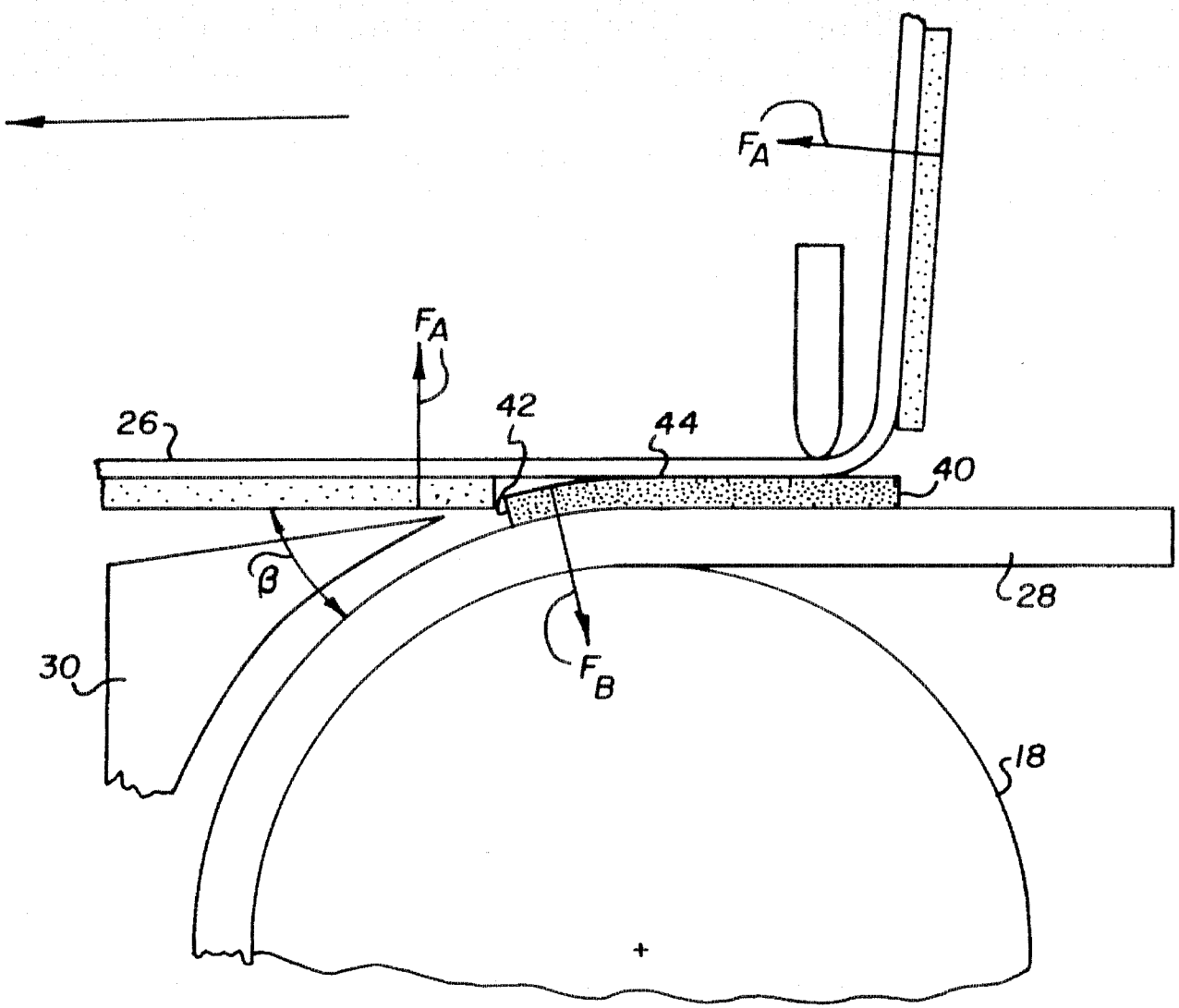
FIG. 7 is a side elevation view, partially in section illustrating the forces on the dye-donor web and the receiver medium during laminate separation at the trailing edge of the lamination according to the present invention.

One of the critical parameters in obtaining a uniform separation at the trailing edge of the lamination is the direction of the separation forces between the dye-donor web and the receiver medium. As shown in FIG. 7, the present invention insures that laminate material on the dye-donor web is forced to separate from the web support as the web and receiver medium are transported in a reverse direction past receiver medium guide 30. This results in a clean and uniform separation at the trailing edge.

At the trailing edge, once the last line of lamination is finished, the print head is raised. Platen assembly 18 and transport mechanism rollers 20 and 22 are driven in reverse; driving receiver medium 28 back along dye receiver medium guide 30. Dye-donor web 26 moves along its path toward supply spool 14, separating from the receiver medium at the edge of the receiver medium guide.

During the separation, the adhesion force $F_A$ between the transferred portion 44 of the laminate material and dye-donor web support 26 should be less than the adhesion force $F_B$ between the transferred portion 44 of the laminate material and the receiver medium. To obtain a clean break of the laminate, the direction vector of $F_A$ relative to the direction of vector of $F_B$ is critical. In the preferred embodiment, the angle β between the directions of vectors $F_A$ and $F_B$ is created by receiver medium guide 30. Since angle β is small, the edge of the receiver medium guide is positioned such that it acts as a stripping bar separating the laminate as the dye-donor web and the receiver medium sandwich rewinds back to the guide.

Another important parameter in obtaining a uniform separation at the trailing edge of the lamination is the separation angle between the dye-donor web and the receiver medium. The larger the angle, the better is the result. It is believed that a large separation angle weakens the polymer chains in the laminate material so that the material tends to break more cleanly in a straight line. When the receiver medium and the dye-donor web are driven in reverse, the separation angle at the trailing edge is created by the configuration of receiver medium guide 30 and print head assembly 12.

For best results, one might manipulate the dye-donor web tension just before and during the rewind step until the separation occurs. If the dye-donor web is left with a small amount of slack before the receiver medium is rewound, an excellent trailing edge separation can be achieved. In the preferred embodiment, this slack is produced by stopping the drive for dye-donor web supply and take-up spools 14 and 16, respectively, and then raising the print head before the rewind step begins. This will produce some slack in the dye-donor web.

When the printing phase is completed, printer 10 enters an ejecting phase, during which the print head assembly is retracted from the platen assembly and the finished print is ejected from the printer. When print head assembly 12 is in the ejecting position, dye receiver medium transport mechanism rollers 20 and 22 captures the dye receiver medium to drive the completed print out of thermal printer 10. When the ejecting phase of the printer operation is finished, the printer is ready to begin another printing operation.

The invention has been described in detail with particular reference to preferred embodiments thereof, but it will be understood that variations and modifications can be effected within the spirit and scope of the invention.

What is claimed is:

1. A printer adapted to receive a web support and a receiver medium, and to thermally-transfer an area of laminate material from received web support to received receiver medium, said printer comprising:

a thermal head;

means defining respective paths for received web support and received receiver medium, said paths converging in a forward direction, to a position at which they abut, before proceeding past the thermal head;

a transport system for moving received web support and received receiver medium (i) in said forward direction along their respective paths past the thermal head whereat heat from the thermal head causes an area of the laminate material coating between a leading edge, in said forward direction, and a trailing edge to transfer from received web support to received receiver medium and (ii) in a reverse direction along their respective paths; and means for causing the trailing edge of the transferred area of the laminate material coating to break cleanly away from a portion of the laminate material coating not transferred from received web support to received receiver medium, leaving the trailing edge straight and even.

2. A printer as defined in claim 1 wherein the laminate material is applied to the received receiver medium to overlie an image carried on the received receiver medium.

3. A printer as defined in claim 1 further comprising a received receiver medium guide positioned between said converging paths to guide the received receiver medium to the thermal head.

4. A printer as defined in claim 3 wherein the area of the laminate material which is transferred to the received receiver medium breaks from the portion of the laminate material not transferred from received web support to received receiver medium as the trailing edge passes the received receiver medium guide.

5. A printer as defined in claim 4 wherein the received receiver medium guide acts as a stripping bar separating the laminate material which is transferred to the received receiver medium from the received web support.

6. A thermal printer adapted to receive a receiver medium and a dye-donor web which includes a patch of thermally-transferable laminate material that can be applied onto the receiver medium over the dye image to form a protective layer, said thermal printer comprising:

a thermal print head;

a transport system for moving received receiver medium and received dye-donor web past the thermal print head to transfer a dye image to the received receiver medium:

means defining respective paths for the received dye-donor web and the received receiver medium, said paths converging in a forward direction, to a position at which they abut, before proceeding past the thermal print head;

drive means, as a part of the transport system, for moving the received dye-donor web and the received receiver medium (i) in said forward direction along their respective paths past the thermal head whereat heat from the thermal head causes an area of the laminate material coating between a leading edge of the area and a trailing edge of the area to transfer from the received dye-donor web to the received receiver medium over the transferred dye image and (ii) in a reverse direction along their respective paths; and means for causing the trailing edge of the transferred area of the laminate material coating to break cleanly away from a portion of the laminate material coating not transferred from received web support to received receiver medium, leaving the trailing edge straight and even.

7. A process for producing thermal prints having a protective layer of laminate material, said process comprising the steps of:

(a) printing a color image onto a receiver medium;

(b) applying a laminate material over the color image by advancing the receiver medium and a donor web past a heat source such that a portion of a patch of laminate material carded by a donor web is applied to the receiver medium over the color image; and (c) rewinding the receiver medium and the donor web along diverging paths after applying a last line of laminate material such that a trailing edge of said portion of the laminate material tends to break cleanly away from a portion of the laminate material not applied to the receiver medium, leaving a straight, even trailing edge.

8. A process as defined in claim 7 further comprising the step of providing slack in the donor web during the rewind step.

9. A process for producing thermal prints having a protective layer of laminate material, said process comprising the steps of:

(a) printing a single color plane onto a receiver medium as the receiver medium moves past a print head from a beginning position;

(b) returning the receiver medium to the beginning position, whereupon another color plane is printed;

(c) repeating steps (a) and (b) until a plurality of color planes have been printed onto the receiver medium;

(d) applying a laminate material over the printed color planes by printing a patch of laminate material, carried by a donor web, onto the printed color planes as the receiver medium moves past the print head;

(e) rewinding the receiver medium and the donor web past a guide after applying a last line of laminate material; and (f) forcing the receiver medium and the donor web to separate at the guide during the rewinding step such that a trailing edge of said portion of the laminate material tends to break cleanly away from a portion of the laminate material not applied to the receiver medium, leaving a straight, even trailing edge.

10. A process as defined in claim 9 further comprising the step of providing slack in the donor web during the rewind step.

* * * * *

UNITED STATES PATENT AND TRADEMARK OFFICE

CERTIFICATE OF CORRECTION

PATENT NO. : 5,555,011
DATED : Sep. 10, 1996
INVENTOR(S) : Manh Tang, Kin K. Lum and James E. Pickering It is certified that error appears in the above-indentified patent and that said Letters Patent is hereby corrected as shown below:

In the Abstract, line 13 delete "aye-donor" and insert --dye-donor--

Signed and Sealed this

Fourteenth Day of October, 1997

*Attest:*

Bruce Lehman

BRUCE LEHMAN

*Attesting Officer*

*Commissioner of Patents and Trademarks*